US007152736B1

(12) United States Patent
Menichini

(10) Patent No.: US 7,152,736 B1
(45) Date of Patent: Dec. 26, 2006

(54) FOAM MATERIAL SPECIMEN TRANSPORT APPARATUS

(76) Inventor: Frank A. Menichini, 1 Gregory La., Newtown Square, PA (US) 19073

( * ) Notice: Subject to any disclaimer, the term of this patent is extended or adjusted under 35 U.S.C. 154(b) by 136 days.

(21) Appl. No.: 10/838,117

(22) Filed: May 3, 2004

(51) Int. Cl.

| | |
|---|---|
| ***B65D 85/20*** | (2006.01) |
| ***B65D 85/30*** | (2006.01) |
| ***B65D 1/34*** | (2006.01) |
| ***A47B 73/00*** | (2006.01) |
| ***B01L 9/06*** | (2006.01) |

(52) U.S. Cl. ..... 206/443; 206/446; 206/523; 206/563; 211/74; 422/102; 422/104

(58) Field of Classification Search ..... 206/443, 206/446, 562–564, 523; 211/74; 422/101–104
See application file for complete search history.

(56) References Cited

U.S. PATENT DOCUMENTS

| | | | | | |
|---|---|---|---|---|---|
| 3,446,342 | A | | 5/1969 | Michel | |
| 3,476,257 | A | * | 11/1969 | O'Connell | 211/69.5 |
| 3,607,134 | A | * | 9/1971 | McIntyre | 422/104 |
| 3,724,654 | A | * | 4/1973 | Gerard et al. | 206/459.5 |
| 4,240,547 | A | | 12/1980 | Taylor | |
| 4,826,003 | A | * | 5/1989 | Levy | 206/443 |
| 4,932,533 | A | | 6/1990 | Collier | |
| 4,963,493 | A | * | 10/1990 | Daftsios | 422/104 |
| 4,970,165 | A | * | 11/1990 | Uhrin | 422/102 |
| 5,040,678 | A | | 8/1991 | Lenmark, Sr. et al. | |
| 5,080,232 | A | * | 1/1992 | Leoncavallo et al. | 206/446 |
| 5,148,919 | A | | 9/1992 | Rubin | |
| 5,291,997 | A | | 3/1994 | He et al. | |
| 5,615,780 | A | * | 4/1997 | Nimetz et al. | 211/74 |
| 5,833,057 | A | | 11/1998 | Char et al. | |
| 5,921,396 | A | | 7/1999 | Brown, Jr. | |
| 5,950,832 | A | * | 9/1999 | Perlman | 206/446 |
| 6,051,191 | A | * | 4/2000 | Ireland | 422/102 |
| 6,345,719 | B1 | | 2/2002 | Jaycox | |
| 6,419,827 | B1 | * | 7/2002 | Sandell et al. | 422/104 |
| 6,719,141 | B1 | * | 4/2004 | Heinz et al. | 206/563 |
| 2004/0022677 | A1 | * | 2/2004 | Wohlstadter et al. | 422/102 |

* cited by examiner

*Primary Examiner*—Bryon P. Gehman
(74) *Attorney, Agent, or Firm*—Michael F. Petock, Esq.; Petock & Petock, LLC

(57) ABSTRACT

A specimen transport apparatus utilizes a rectangular block of high density foam material containing a plurality of elongated receptacles formed in the block. The receptacles are arranged in a grid formation in two orthogonal directions. Each receptacle is provided with a foam extension extending into the receptacle space from a receptacle wall to firmly hold specimen vials in place within the receptacle. The block of foam material is contained within a box provided with different indicia in two orthogonal directions for identifying each receptacle whereby any vial contained in any receptacle may be positively identified by a combination of one of each of the two different indicia.

5 Claims, 2 Drawing Sheets

FIG.2
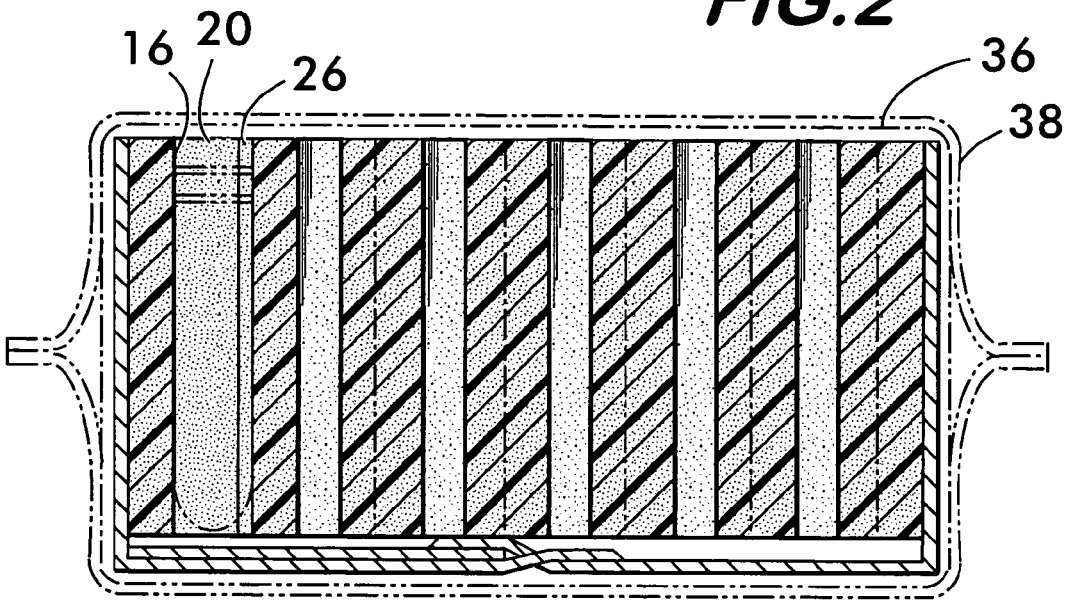
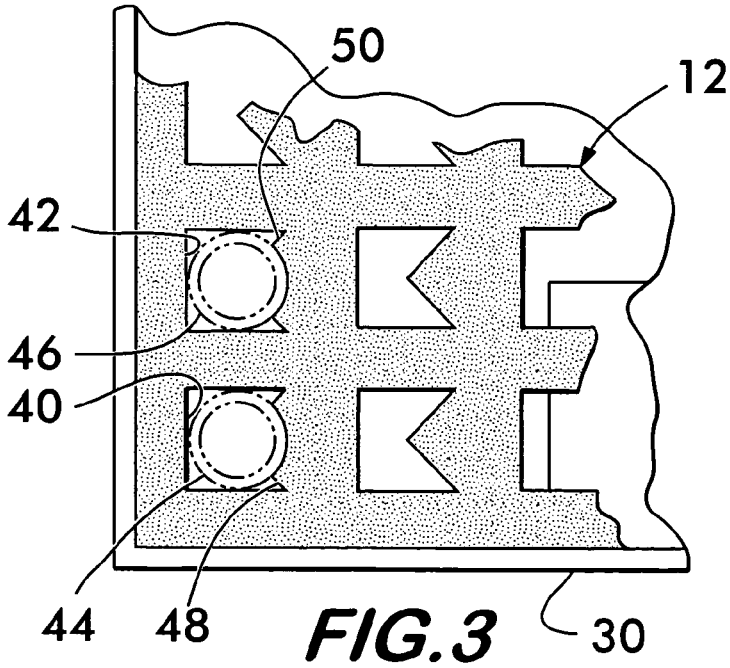
FIG.3

FOAM MATERIAL SPECIMEN TRANSPORT APPARATUS

FIELD OF THE INVENTION

The present invention relates to a specimen transport apparatus. More particularly, the present invention relates to a specimen transport apparatus wherein specimen vials are protected, held firmly in place and positively identified.

BACKGROUND OF THE INVENTION

There is a need for a cost effective means of transporting or shipping a plurality of biological specimen vials from one location to another. Often, specimens are collected at various locations and tests are performed at another location. Tests on the biological specimens may be performed at a remote location for various reasons, including economy of scale and/or special expertise.

SUMMARY OF THE INVENTION

The present invention provides an advantage in that it is a cost effective apparatus for transporting specimen vials, usually biological specimen vials, from one location to another.

Another advantage of the present invention is that the specimen vials are held securely in place.

Another advantage of the present invention is that the vials are protected from outside force or trauma.

Another advantage of the present invention is that the individual vials may be readily identified by indicia in two orthogonal directions identifying any particular receptacle for a vial in a grid arrangement.

In accordance with the present invention, a specimen transport apparatus comprises a rectangular block of foam material. A plurality of elongated receptacles are formed in the block. The plurality of receptacles are arranged in a grid formation in two orthogonal directions. Each of the elongated receptacles is provided with a foam extension extending into the receptacle from a receptacle wall. Each receptacle is adapted to receive a vial for a specimen. The foam extension projects against the vial to securely hold the vial in place. A box is provided for receiving the rectangular block of foam material. The box is provided with different indicia thereon in two orthogonal directions for identifying each receptacle, whereby a vial in any receptacle may be identified by a combination of one of each of the two different indicia.

In a presently preferred embodiment, the foam material is a high density foam material in the form of polyether foam.

In a presently preferred embodiment, the rectangular block of foam is the special case of the rectangular block being square. Further, in a presently preferred embodiment, the specimen transport apparatus is provided with a plurality of receptacles arranged in a grid formation in two orthogonal directions which are comprised of six rows and six columns of receptacles in each of two orthogonal directions.

Further, in a presently preferred embodiment, the foam extensions extending into the receptacles are triangular in shape and the receptacles are substantially square, except for the triangular shape projecting therein.

In a presently preferred embodiment, the box is provided with alphabetical indicia in one direction and numerical indicia in an orthogonal second direction.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 2 is a cross sectional view taken along line 2—2 of FIG. 1 with additional packaging shown in doted outline form.

FIG. 3 is an enlarged plan view partially broken away of a portion of a block of foam with vials shown in dotted outline form in two of the receptacles.

DETAILED DESCRIPTION OF THE PREFERRED EMBODIMENTS

Figure 1:
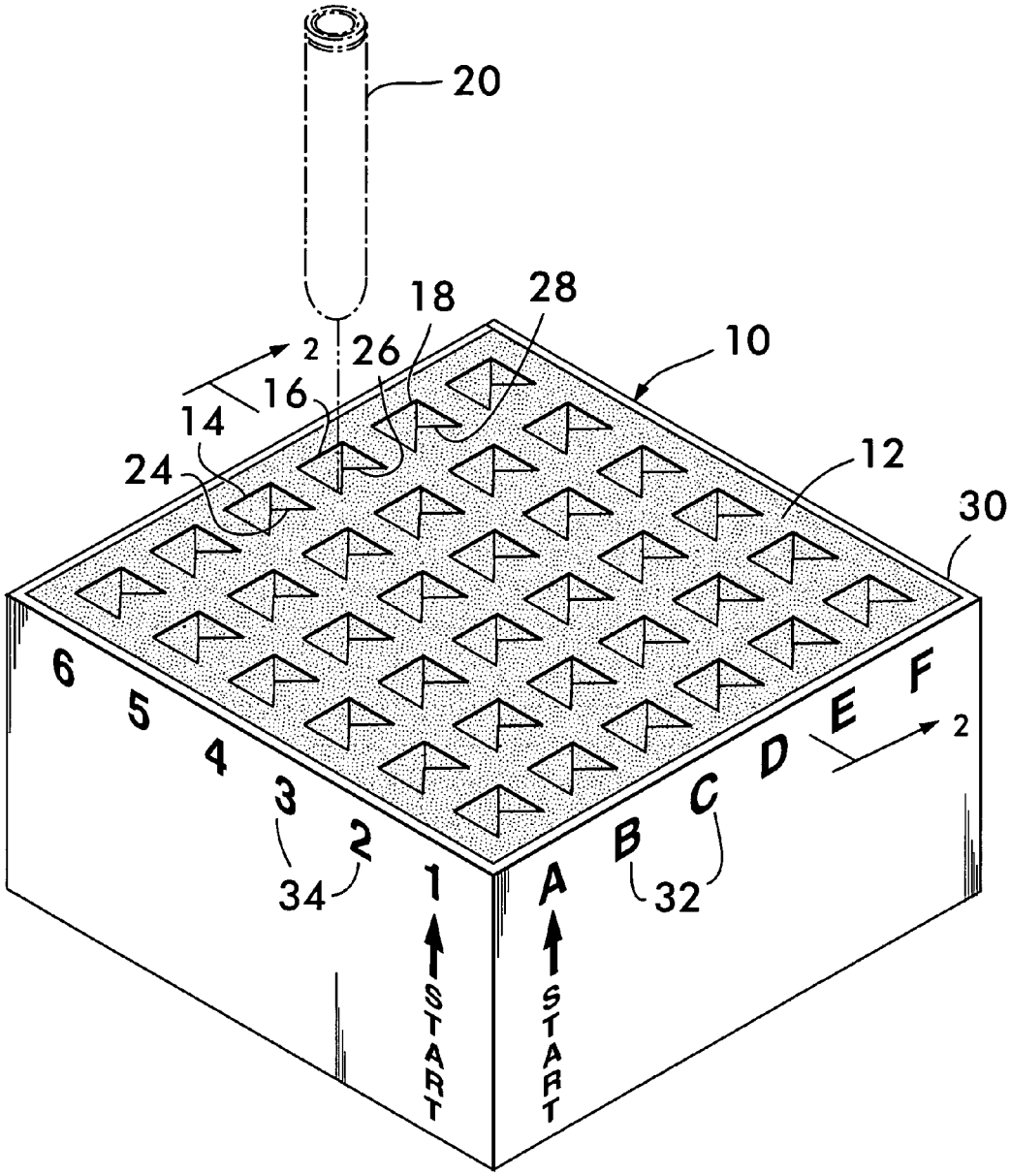
FIG. 1 is a view in perspective of a specimen transport apparatus in accordance with the present invention illustrating a rectangular block of foam with receptacles contained within a box bearing suitable indicia in two orthogonal directions.

Referring now to the drawings, wherein like numerals indicate like elements, there is shown in FIG. 1 a specimen transport apparatus 10 in accordance with the present invention. The specimen transport apparatus includes a rectangular block of foam material 12. The foam material comprising block 12 may be any suitable foam material, but preferably is comprised of a high density foam material and particularly high density polyether foam. High density foam material provides enhanced protection for the vials being shipped within the transport apparatus. Other high density foam materials may be utilized.

The rectangular block of foam material 12 is provided with a plurality of elongated receptacles such as those indicated at 14, 16 and 18. The elongated nature of the receptacles is best illustrated in FIG. 2, and particularly see elongated receptacle 16 shown therein. The receptacles are arranged in a grid formation in two orthogonal directions as illustrated in FIG. 1. Each of the elongated receptacles is provided with a foam extension extending into the receptacle from a receptacle wall. As illustrated in FIG. 1, the foam extension is preferably triangular in cross section. For example, elongated receptacle 14 is provided with foam extension 24 with a cross sectional shape of a triangle, elongated receptacle 16 is provided with foam extension 26 in the cross sectional shape of a triangle and elongated receptacle 18 is provided with foam extension 28 in the form of a triangle in cross section. Each elongated receptacle is adapted to receive a vial for a specimen, which in many cases will be a biological specimen being shipped for testing or the like. As illustrated in FIG. 1, vial 20 is about to be inserted into receptacle 16.

In FIG. 2, vial 20 is shown as being inserted within receptacle 16 and is firmly held in place by partially compressed foam extension 26.

Referring back to FIG. 1, rectangular foam block 12 is contained within a box 30. Box 30 is provided with different indicia thereon in two orthogonal directions for identifying each receptacle whereby a vial in any receptacle may be identified. More particularly, as illustrated in FIG. 1, in a first orthogonal direction there is illustrated the letters A through F, indicated by the numeral 32. The letters A through F are alphabetical indicia identifying each of six columns of receptacles. Along a second orthogonal direction, box 30 is marked with numerical indicia 1 through 6 identified by the numeral 34. Each numeral identifies a particular row. In this manner, any particular receptacle, and more particular any particular vial in a particular receptacle, may be identified by an alpha numeric designation. For example, a vial placed in the first row of the first column would be identified as A1. Vial 20 would be identified by the alpha numeric designation of D6. In this manner, a list may be transported with the specimen transport apparatus or may be otherwise communicated from the sender to the receiver, such as by fax or e-mail, identifying each vial contained within the transport apparatus by an alpha numeric designator. For example, if vial 20 is the blood of John Doe, this may be identified as vial D6 containing the blood of John Doe. The recipient in this manner can easily, quickly and efficiently select any particular vial by its positive identification.

As illustrated in FIG. 2, specimen transport apparatus of the present invention would typically be shipped with an absorbing layer of material 36 surrounding it and an outer sealed plastic bag or container 38. Absorbing material 36 and outer plastic bag or container 38 are shown in dotted outline form in FIG. 2.

Referring now to FIG. 3, there is shown a broken away portion of box 30 with receptacles 40 and 42 containing vials 44 and 46, respectively. Vials 44 and 46 are shown in dotted outline form. Compressing the triangular shaped foam extensions 48 and 50, respectively. Foam extensions 48 and 50 firmly hold the vials in place. It is understand that the foam extensions need not be triangular shaped, although a triangular shaped foam extension is a presently preferred embodiment. Other various shapes of material may be utilized to extend into the normally square space of the receptacle.

The present invention may be embodied in other specific forms without departing from the spirit or essential attributes thereof and, accordingly, reference should be made to the appended claims, rather than to the foregoing specification as indicating the scope of the invention.

I claim:

1. A biological specimen transport apparatus, comprising:

a rectangular block of foam material;

a plurality of elongated receptacles formed in said block having three straight sides and a projecting foam extension, said plurality of receptacles being arranged in a grid formation in two orthogonal directions;

each of said elongated receptacles having said foam extension extending substantially the entire length of the receptacle and into said receptacle from a receptacle wall approximately half the width of the receptacle, said foam extension being triangular in cross section, each said receptacle being adapted to receive a vial for a biological specimen, said foam extension projecting against the vial and being substantially compressed by the vial to securely hold the vial in place during transport of said biological specimen; and a box for receiving said rectangular block of foam material, said box having different indicia thereon in two orthogonal directions for identifying each receptacle, whereby a vial in any receptacle may be identified by a combination of one of each of the two different indicia.

2. A specimen transport apparatus in accordance with claim 1 wherein said rectangular block is square.

3. A specimen transport apparatus in accordance with claim 1 wherein said plurality of receptacles arranged in a grid formation in two orthogonal directions is comprised of six rows or columns of receptacles in each of two orthogonal directions.

4. A specimen transport apparatus in accordance with claim 1 wherein said box is provided with alphabetical indicia in one direction and numerical indicia in an orthogonal second direction.

5. A specimen transport apparatus in accordance with claim 1 wherein said box is constructed of cardboard.

* * * * *